United States Patent [19]

Bothner

[11] Patent Number: 4,646,390

[45] Date of Patent: Mar. 3, 1987

[54] ROVING COILER

[75] Inventor: Jakob Bothner, Jebenhausen, Fed. Rep. of Germany

[73] Assignee: Zinser Textilmaschinen GmbH, Ebersbach/Fils, Fed. Rep. of Germany

[21] Appl. No.: 703,933

[22] Filed: Feb. 21, 1985

[30] Foreign Application Priority Data

Feb. 28, 1984 [DE] Fed. Rep. of Germany ..... 3407135

[51] Int. Cl.[4] ..... D04H 11/00

[52] U.S. Cl. ..... 19/159 R

[58] Field of Search ..... 19/159 R, 159 A; 28/289

[56] References Cited

U.S. PATENT DOCUMENTS

| | | | |
|---|---|---|---|
| 3,324,515 | 6/1967 | West | 19/159 R |
| 4,041,574 | 8/1977 | Müller | 19/159 R |
| 4,223,422 | 9/1980 | Weber | 19/159 R |
| 4,236,279 | 12/1980 | Kawaura | 19/159 R |

FOREIGN PATENT DOCUMENTS

| | | | |
|---|---|---|---|
| 7603877 | 9/1976 | Fed. Rep. of Germany | |
| 2084199 | 4/1982 | United Kingdom | 19/159 R |

*Primary Examiner*—Louis K. Rimrodt
*Assistant Examiner*—Judith L. Olds
*Attorney, Agent, or Firm*—Karl F. Ross; Herbert Dubno

[57] ABSTRACT

In order to reduce the friction of the roving against the annular cover of the can receiving the roving and surrounding the rotatable coiler, the cover is rotatable about the rotation axis of the coiler.

11 Claims, 5 Drawing Figures

ROVING COILER

FIELD OF THE INVENTION

My present invention relates to a roving coiler and, more particularly, to an apparatus for coiling or depositing roving in a rotating can for further processing by spinning, drafting, twisting or the like.

BACKGROUND OF THE INVENTION

An apparatus for depositing roving in a rotating can in cycloid-shaped loops typically comprises a rotatable upwardly open can, a cover with an opening through which the roving is deposited in the drum by means of a turntable or coiler having a guide passage with a lower passage mouth opening toward the can.

The rotation axis of the coiler turntable is offset from the rotation axis of the can. Furthermore the funnel-shaped or tapered roving guide passage usually has an upper opening or mouth centrally located on the coiler turntable, while the lower passage mouth is customarily positioned adjacent the inner wall of the can.

This kind of apparatus has been used, for example, in drawing frames in the formation of drawing ribbons or bands, in transfer apparatus for transfer of roving from large to small cans, and in carding or combing machines.

Not only the rotation of the coiler turntable, but also the rotation of the can leads to friction between both the undersurface of the turntable and the undersurface of the cover surrounding the coiler turntable and the mass of roving in the can. The friction impairs the quality of the roving deposited in the can.

OBJECTS OF THE INVENTION

A general object of my invention is to provide an improved apparatus for depositing roving in a rotating can.

It is a specific object of the invention to provide an improved apparatus for depositing roving in a rotating can in which friction upon the roving is minimized providing minimal impairment of the stored roving.

It is yet another object of the invention to provide an improved apparatus for coiling roving in a rotating can in which specifically the roving is not damaged by friction caused by pressing of the roving mass against the underside of the cover or turntable.

SUMMARY OF THE INVENTION

These objects and others which will become more apparent hereinafter are attained in accordance with the invention in an apparatus for depositing of roving in a rotating can comprising a rotatable upwardly open can, a rotatable coiler turntable above the opening of the can and having a roving guide passage with a lower mouth opening into the can, wherein the rotation axis of the coiler turntable is offset from the rotation axis of the can. Customarily the funnel-shaped guide passage has an upper opening or mouth centrally located on the top of the funnel-shaped or cone-shaped coiler turntable, while the lower passage is positioned adjacent the inner wall of the can.

According to this invention the cover of the can is rotatable about the rotation axis of the coiler turntable.

To the extent that the cover is freely rotatable it is set into rotation by the contact of the roving package with the cover as the can rotates and thus rotates at the same speed so that the friction effect is minimized.

Advantageously the cover is constructed as an annular ring, which, for example, has a sufficiently large outer diameter, so that it completely covers the can.

According to a further feature of the invention the cover is rotatably supported with a roller bearing that is supported by a fixed carrier ring positioned to define a rotation axis coincident with the rotation axis of the coiler turntable, the ring being concentric therewith. This ring has the smallest possible diameter so that the mounting expense and the journaling losses are minimized.

Of course it is basically possible to support the rotatable cover on part of the coiler turntable so as to avoid the above-mentioned type of carrier ring. Such an arrangement can lead, however, to the unfortunate situation that the weight of the coiler turntable and the rotatable cover must both be taken up by the bearings at higher cost and that high relative velocities may result.

The fixed ring can be employed both for support of the rotatable cover and also of the coiler turntable, when according to a further feature of the invention, the ring is positioned on the inside of the rotatable cover and on the outside of the coiler turntable.

It has already been mentioned that the rotatable cover can be arranged and positioned to be freely rotatable. However in this case starting and stopping of the coiler turntable or the can drive or starting or stopping of the rotatable cover results in an increased friction between the cover and the roving in the can which can be avoided if, according to a further feature of the invention, the rotatable cover is connected to a drive apparatus. This drive apparatus can then be controlled so that the rotatable cover in starting or stopping of the coiler turntable or the can, can be speeded up or slowed down synchronously with the roving material independently of its inertia.

To reduce the friction between the rotating parts and the roving in the can still further, according to a further feature, the apparatus is provided with a freely rotatable auxiliary or bottom plate which does not block the lower roving passage mouth under the rotatable part of the coiler turntable.

The roving of the can is then prevented from reaching the coiler turntable by the freely rotatable auxiliary plate.

An exception to this is that part of the coiler turntable found adjacent the lower passage mouth. These parts of the coiler turntable are set back from the freely rotatable auxiliary plate so that at most only a reduced friction can occur when roving come in contact with the driven rotating part of the coiler turntable.

When, according to the invention, a freely rotatable auxiliary plate is provided and positioned as described, its rotation results from the deposition of the roving in cycloidal loops and from the rotation of the can. The rotary motion of the plate will be arranged therefore always in a way so that the relative motion between the plate and the roving material and the friction is reduced.

According to yet another feature of the invention this auxiliary plate mounted in the coiler turntable is supported eccentric to the rotation axis of the coiler turntable. Thus the rotation required of the auxiliary plate is synchronized automatically with the rotation of the coiler turntable about the rotation axis of the coiler turntable.

According to a further preferred feature of the invention the rotation axis of the auxiliary plate is spaced from the rotation axis of the coiler turntable so that between the edge of the auxiliary plate and the edge of the coiler turntable circular arc shaped cut-outs appear forming a moon crescent like gap exposing the lower passage mouth when viewed from the bottom of the can.

This arrangement is preferred because the freely rotatable auxiliary plate can rotate in the same cover opening in which the coiler turntable rotates wherein, however, the auxiliary plate uncovers a portion of the coiler turntable as described. The freely rotating auxiliary plate lies advantageously on the lower or bottom surface plane of the rotatable cover which receives the coiler turntable in its cover opening so that the auxiliary plate forms together with the rotatable cover a pressing arrangement for the roving of the can lying at the same height relative to it.

A particularly small contacting surface between the coiler turntable and the roving material of the can results when, according to another feature of the invention, the surface of the coiler turntable standing in contact with the roving material of the can is formed as an annular ring. In order that the inside of the annular ring be filled up for the purpose of a better roving contact, particularly for roving preservation, a base plate freely rotatable about the axis of the coiler turntable can advantageously be positioned inside of the annular ring. The underside of this freely rotatable base plate can be aligned with the underside of the annular ring and with the freely rotatable cover.

BRIEF DESCRIPTION OF THE DRAWING

The above and other objects, features and advantages of my invention will become more readily apparent from the following description, reference being made to the accompanying drawing, in which.

SPECIFIC DESCRIPTION

Figure 1:
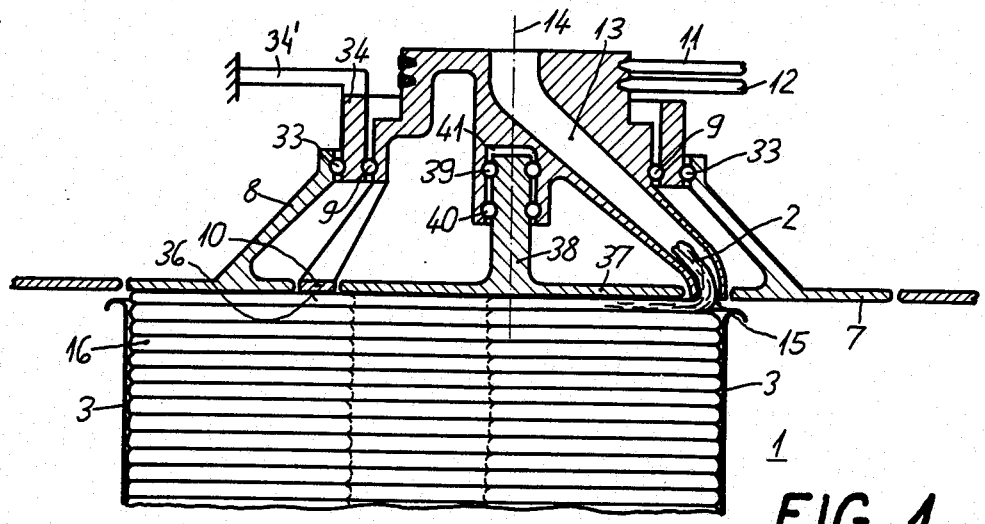
FIG. 1 is a schematic vertical cross sectional view through part of a roving coiler according to the invention.
Figure 2:
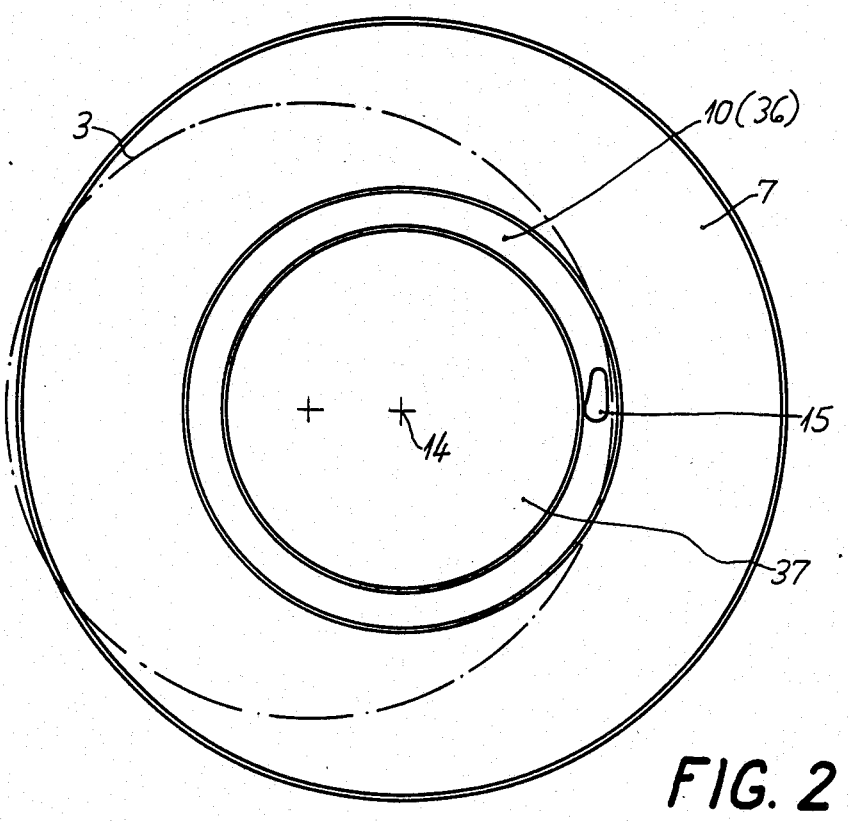
FIG. 2 is a view from below of the apparatus of FIG. 1.
Figure 5:
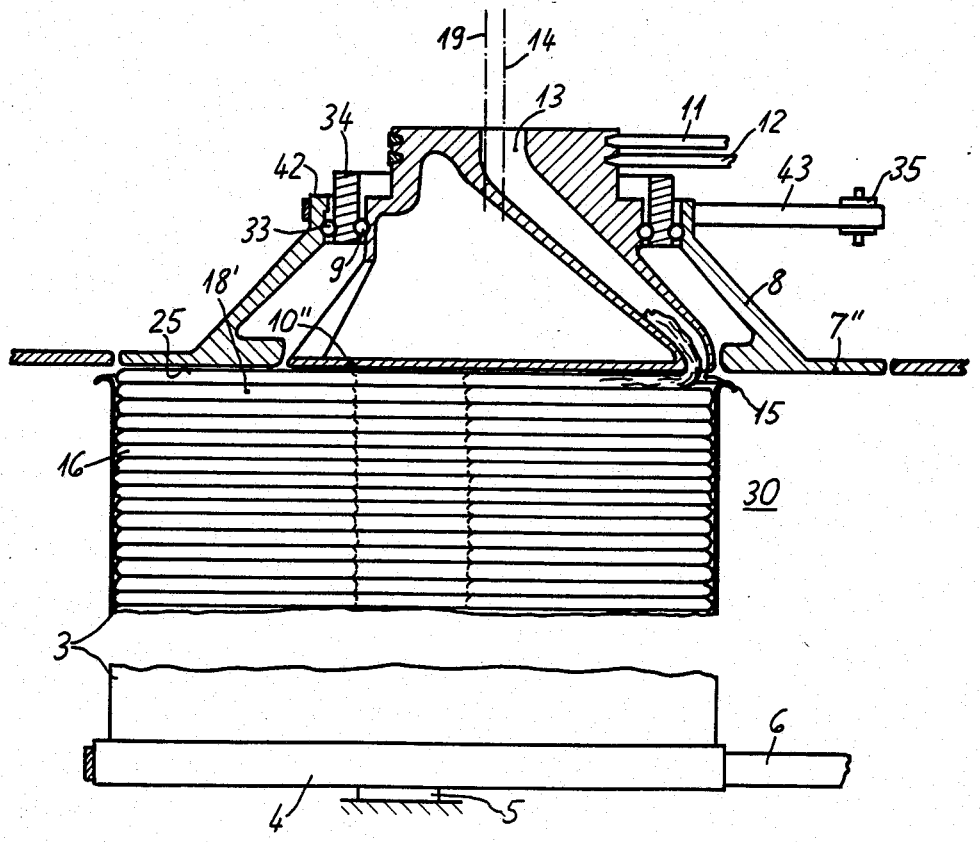
FIG. 5 is a schematic vertical cross sectional view through yet another different embodiment of the apparatus.

In the first embodiment shown in FIGS. 1 and 2, the novel apparatus 1 for depositing roving 2, consisting of spun fiber, in can 3, has a rotating support for the can only shown completely in FIG. 5, the can 3 being supported by a can base 4, which is pivotally supported by means of a pivot 5.

The base 4 is driven by drive belt 6.

Over the can 3 a coiler turntable or coiler 10 is supported rotatably on a bearing ring 34 by roller bearings 9 inside a rotatably supported cover 7 which has a supporting structure 8.

The coiler 10 is driven by two cone belts 11 and 12. In the inside of the coiler 10 a funnel-shaped tapered roving guide passage 13 is found, this passage beginning at its upper end on the rotation axis 14 of the coiler turntable 10 and whose passage mouth 15 at its lower end opens into the upper can opening. The passage mouth 15 is found near the outer edges of the coiler turntable 10 which, with its undersurface 36, is in contact with the roving 16, the surface 36 being constructed as an annular-shaped surface.

FIG. 1 shows that a freely rotatable circular base plate 37 is positioned so as to rotate about a rotation axis coincident with the rotation axis 14 of the coiler turntable 10 inside of the ring-shaped area or annular ring 36 of the coiler turntable 10.

In order to guarantee the free rotation of the base plate 37, the base plate 37 is formed with a drive shaft 38 which projects perpendicularly from the plate. The shaft is supported by two roller bearings 39 and 40 in a recess 41 formed in the coiler turntable 10.

The cover 7 is constructed as a circular ring also. Its supporting structure 8 is mounted on carrier ring 34 with a roller bearing 33 and the carrier ring 34 also supports the roller bearing 9 journaling the coiler turntable 10. The ring 34 is fixed to a part of the machine frame at 34'.

Figure 3:
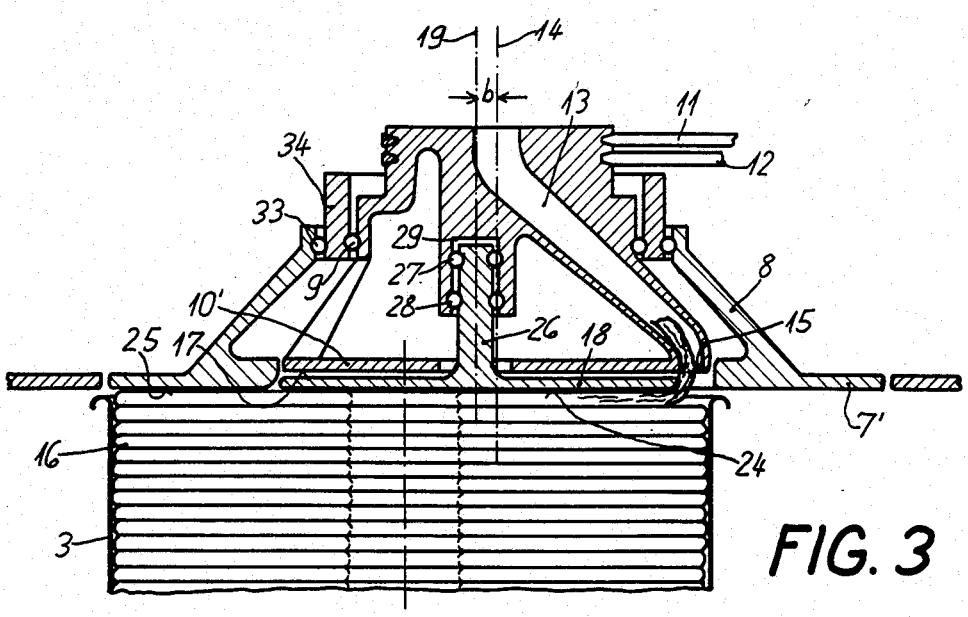
FIG. 3 is a schematic vertical cross sectional view through another embodiment of the apparatus for depositing roving in a rotating can.
Figure 4:
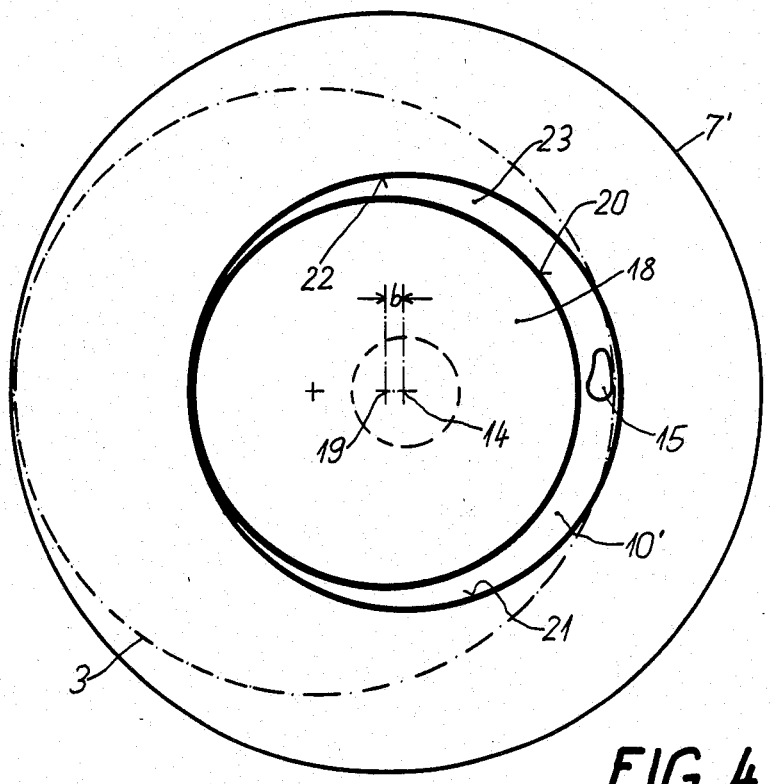
FIG. 4 is a view from below of the apparatus of FIG. 3.

In the second embodiment according to FIGS. 3 and 4 the coiler turntable 10' is rotatable on a carrier ring 34 via a roller bearing 9 which carries a cover 7' rotatable on bearings 33. The coiler turntable 10' is driven by two V-belts 11 and 12. In the inside of the coiler turntable 10' a guide passage 13 is provided which begins at the upper end of the coiler turntable 10' on the rotation axis 14 of the coiler turntable 10 and whose passage mouth opens at its lower end into the upper can opening. The passage mouth 15 is found in the vicinity of the outer edges of the coiler turntable 10'.

FIG. 3 shows that the rotating parts of the coiler turntable 10' are separated from the can 3 and its roving 16 by the rotatable auxiliary plate 18, so constructed as not to block the passage mouth 15, beneath the underside 17 of the coiler turntable 10'. The rotation axis 19 of the auxiliary plate 18 is parallel to, but not identical with, the rotation axis 14 of the coiler turntable 10'.

The auxiliary plate 18 is circular and, on coiler turntable 10', as the drawing shows, is supported with its rotation axis off-center or eccentric, i.e. offset by a distance b from the axis 14 of the coiler turntable 10' and, of course, the rotation axis 19 of the auxiliary plate 18 is spaced from the passage mouth 15 so far from the axis of rotation 14 of the coiler turntable 10' that between the edge 20 of the auxiliary plate 18 and the edge 21 of the coiler turntable 10', circular arc-shaped cutouts 22 form a crescent-shaped gap 23 for the passage mouth 15. The auxiliary plate 18 does not project beyond the lower plane 25 of the cover 7' during rotation of the cover 7'.

To guarantee free rotation of the auxiliary plate 18, it is perpendicular to a drive shaft 26 which is supported by roller bearings 27 and 28 in recess 29 of the coiler turntable 10'.

Another embodiment of the invention similar to that shown in FIGS. 3 and 4 is indicated in FIG. 5 in which the entire apparatus for depositing roving in a can is indicated by the numeral 30. The individual items making up this apparatus are seen to have a similar form to those of FIGS. 3 and 4 and, consequently, those portions which are the same are not described again here. The drive for the can 3 for example was already clearly described in connection with the first embodiment. Several individual items are included or modified in this embodiment, and these items will now be described.

The upper end of the supporting structure 8 of the rotatable cover 7' is constructed as a belt pulley 42, which is connected by a tensional medium or belt 43 with a drive apparatus 35. The latter can be synchronized with the drive for belt 6. The coiler turntable 10'' has a completely planar underside with the exception of the passage mouth 15.

In all specific embodiments, the edges of the cover, coiler turntable and auxiliary plate are shown rounded, slanted or well smoothed so that the roving material will not be damaged by the cover, coiler turntable or auxiliary plate.

I claim:

1. An apparatus for depositing roving in a can comprising:

means for rotatably supporting an upwardly open can adapted to receive a roving and having an axis of rotation;

a coiler body rotatable above the open can about a coiler-body axis offset from the axis of rotation of said can, said coiler being formed with a guide passage for the roving having a mouth opening into said can and orbiting said coiler-body axis upon rotation of said coiler body;

a cover in the form of a circular ring surrounding said coiler and covering the opening of said can; and means for journaling said ring for rotation independently of said body and said can about the axis of said coiler which is offset from the axis of rotation of said can to reduce friction between roving in said can and said cover.

2. The apparatus defined in claim 1 wherein said ring forming said cover is mounted with a roller bearing on a carrier ring.

3. The apparatus defined in claim 2 wherein said carrier ring supports and is concentric with said coiler body.

4. The apparatus defined in claim 2 wherein said carrier ring is stationarily supported and is positioned in the inside of said ring forming said cover and on the outside of said coiler body.

5. The apparatus defined in claim 1 wherein said ring forming said cover is coupled to a drive apparatus for rotation thereof.

6. The apparatus defined in claim 1 wherein said coiler body includes a ring coplanar with the circular ring forming said cover and provided with said mouth.

7. The apparatus defined in claim 6, further comprising a circular base plate journaled in said body about said axis of rotation of said body, coplanar with said rings and surrounded by said rings, said base plate being freely rotatable in said body.

8. An apparatus for depositing roving in a can comprising:

means for rotatably supporting an upardly open can adapted to receive a roving and having an axis of rotation;

a coiler rotatable above the open can about an axis offset from the axis of rotation of said can, said coiler being formed with a guide passage for the roving having a mouth opening into said can;

a cover surrounding said coiler and covering the opening of said can; and means for journaling said cover for rotation about the axis of said coiler to reduce friction between roving in said can and said cover, said coiler having a rotatable body formed with said passage and being provided with a freely rotatable auxiliary plate on the underside of said body, said auxiliary plate being journaled on said coiler eccentrically with respect to the axis of the coiler.

9. The apparatus defined in claim 8 wherein said auxiliary plate has an axis spaced from said axis of said coiler in a direction away from said passage mouth by at least a distance equal to the width of said passage mouth so that between an edge of said auxiliary plate and an edge of said coiler, a crescent-shaped gap is formed so that said lower passage mouth is not blocked.

10. The apparatus defined in claim 9 wherein said auxiliary plate has an underside lying in a lower surface plane of said body.

11. The apparatus defined in claim 8 wherein said coiler has a surface in contact with said roving in said can and formed as a circular ring.

* * * * *